US012540605B2

(12) United States Patent
Akami

(10) Patent No.: US 12,540,605 B2
(45) Date of Patent: Feb. 3, 2026

(54) HYDRAULIC PUMP WITH SWASH PLATE TILT CONTROL

(71) Applicant: NABTESCO CORPORATION, Tokyo (JP)

(72) Inventor: Toshiya Akami, Gifu-ken (JP)

(73) Assignee: NABTESCO CORPORATION, Tokyo (JP)

( * ) Notice: Subject to any disclaimer, the term of this patent is extended or adjusted under 35 U.S.C. 154(b) by 0 days.

(21) Appl. No.: 18/168,108

(22) Filed: Feb. 13, 2023

(65) Prior Publication Data

US 2023/0193886 A1 Jun. 22, 2023

Related U.S. Application Data

(62) Division of application No. 16/402,536, filed on May 3, 2019, now Pat. No. 11,603,830.

(30) Foreign Application Priority Data

May 17, 2018 (JP) ..... 2018-095555

(51) Int. Cl.
*F04B 1/324* (2020.01)
*F04B 27/08* (2006.01)
(Continued)

(52) U.S. Cl.
CPC ..... *F04B 1/324* (2013.01); *F04B 27/0878* (2013.01); *F04B 27/22* (2013.01); *F04B 49/002* (2013.01); *F04B 49/12* (2013.01)

(58) Field of Classification Search
CPC ..... F04B 1/324; F04B 1/32; F04B 49/002; F04B 27/22; F04B 49/12; F04B 27/32; F04B 27/03; F04B 1/34
See application file for complete search history.

(56) References Cited

U.S. PATENT DOCUMENTS 2,915,985 A * 12/1959 Budzich ..... F04B 49/08 92/57
3,221,660 A * 12/1965 Michael ..... F04B 1/324 417/222.1
(Continued)

FOREIGN PATENT DOCUMENTS

CN 1147847 A 4/1997
CN 106481526 A 3/2017
(Continued)

OTHER PUBLICATIONS

Chinese Office Action issued in Chinese Patent Application No. 201910355567.3, dated Apr. 6, 2022.
(Continued)

*Primary Examiner* — Bryan M Lettman
(74) *Attorney, Agent, or Firm* — Pillsbury Winthrop Shaw Pittman, LLP

(57) ABSTRACT

A hydraulic pump that allows a drive source to be started with a small torque includes a cylinder block having a plurality of cylinder bores and disposed so as to be rotatable. Pistons are each movably retained in an associated one of the cylinder bores. A swash plate controls the amount of movement of the pistons in accordance with the size of the tilt angle. A first pressing unit is configured for pressing the swash plate in such a direction as to reduce the tilt angle of the swash plate, and a second pressing unit is configured for pressing the swash plate to increase the tilt angle of the swash plate by the pressure supplied from the outside.

6 Claims, 9 Drawing Sheets

(51) Int. Cl.

| | |
|---|---|
| ***F04B 27/22*** | (2006.01) |
| ***F04B 49/00*** | (2006.01) |
| ***F04B 49/12*** | (2006.01) |

(56) References Cited

U.S. PATENT DOCUMENTS

| | | | | |
|---|---|---|---|---|
| 3,426,686 | A | 2/1969 | Anderson | |
| 3,738,779 | A * | 6/1973 | Hein | F04B 49/08 91/506 |
| 3,834,836 | A * | 9/1974 | Hein | F04B 49/08 60/413 |
| 4,097,196 | A * | 6/1978 | Habiger | F04B 49/08 417/222.1 |
| 5,251,536 | A | 10/1993 | Engel | |
| 5,251,537 | A * | 10/1993 | Hoshino | F04B 1/324 91/506 |
| 5,758,499 | A | 6/1998 | Sugiyama | |
| 10,145,368 | B2 | 12/2018 | Iwanaji | |
| 2002/0176784 | A1* | 11/2002 | Du | F04B 1/324 417/213 |
| 2013/0098022 | A1 | 4/2013 | Kim | |
| 2014/0328700 | A1* | 11/2014 | Iwanaji | F04B 27/086 417/222.1 |
| 2015/0337813 | A1 | 11/2015 | Iwanaji | |
| 2015/0377223 | A1* | 12/2015 | Achten | F04B 49/12 417/213 |
| 2016/0025081 | A1* | 1/2016 | Porel | F03C 1/0636 417/217 |

FOREIGN PATENT DOCUMENTS

| | | | |
|---|---|---|---|
| CN | 107542634 | A | 1/2018 |
| DE | 102013225569 | A1 | 6/2015 |
| EP | 2933486 | A1 | 10/2015 |
| EP | 2933486 | B1 | 7/2017 |
| JP | 58-113880 | U | 8/1983 |
| JP | 5-26151 | A | 2/1993 |
| JP | H0544631 | A | 2/1993 |
| JP | 7-189916 | A | 7/1995 |
| JP | 2002-138948 | A | 5/2002 |
| JP | 2002357177 | A | 12/2002 |
| JP | 2005201301 | A | 7/2005 |
| JP | 2013-113187 | A | 6/2013 |
| JP | 2014-145268 | A | 8/2014 |
| JP | 2014-194159 | A | 10/2014 |
| JP | 2017-036689 | A | 2/2017 |
| JP | 2017-78382 | A | 4/2017 |
| JP | 2017180391 | A | 10/2017 |
| JP | 2018-003609 | A | 1/2018 |

OTHER PUBLICATIONS

Japanese Office Action issued in Japanese Patent Application No. 2018-095555, dated Mar. 4, 2022.

Decision of Refusal dated Aug. 23, 2022, issued in corresponding Japanese Patent Application No. 2018-95555.

Office Action dated Aug. 30, 2022, issued in corresponding Chinese Patent Application No. 201910355567.3.

Extended European Search Report EP Application No. 1972529.0 dated Jul. 2, 2019.

Notice of Reasons for Refusal dated Aug. 25, 2023, issued in corresponding Japanese Patent Application No. 2022-186667 with English translation (8 pgs.).

Notice of Reasons for Refusal dated Feb. 2, 2024, issued in corresponding Japanese Patent Application No. 2022-186667 with English translation (11 pgs.).

Notice of Submission of Agency Opinion dated Nov. 21, 2023, issued in corresponding Korean Patent Application No. 10-2019-0051940 with English translation (8 pgs.).

Office Action dated Apr. 24, 2025, issued in corresponding Chinese Patent Application No. 202211610020.1 with English translation (15 pgs.).

Second Office Action dated Oct. 29, 2025, issued in corresponding Chinese Patent Application No. 202211610020.1 with English machine translation (11 pgs.).

* cited by examiner

HYDRAULIC PUMP WITH SWASH PLATE TILT CONTROL

CROSS-REFERENCE TO RELATED APPLICATIONS

This application is a Divisional Application of U.S. Ser. No. 16/402,536, filed May 3, 2019, which is based on and claims the benefit of priority from Japanese Patent Application Serial No. 2018-095555, filed May 17, 2018, the contents of each of which are hereby incorporated by reference in its entirety.

TECHNICAL FIELD

The present invention relates to a hydraulic pump used in construction vehicles and the like.

BACKGROUND

Hydraulic pumps are used in a wide range of fields such as construction vehicles. By way of an example, a hydraulic pump includes a rotary shaft, a cylinder block having a plurality of cylinder bores extending along the direction of the rotary shaft, pistons each retained in associated one of the cylinder bores so as to be movable, a swash plate for moving each of the pistons in the associated one of the cylinder bores when the cylinder block rotates, and a mechanism for varying the tilt angle of the swash plate with respect to the rotary shaft of the cylinder block. The rotary shaft is connected to an engine serving as a drive source. The above hydraulic pump may be used as, among others, a variable displacement hydraulic pump. One example of such a variable displacement hydraulic pump is disclosed in Japanese Patent Application Publication No. 2002-138948A ("the '948 Publication").

Such a hydraulic pump outputs a drive force based on discharge of a fluid from the cylinder bores. More specifically, the power from the engine rotates the rotary shaft, causing rotation of the cylinder block connected with the rotary shaft. The rotation of the cylinder block causes the pistons to reciprocate. In accordance with the reciprocation of the pistons, the fluid is discharged from some cylinder bores and also sucked into the other cylinder bores, thereby accomplishing the operation of the hydraulic pump. In this operation, the swash plate is tilted to a large tilt angle by a pressing unit such as a spring provided in a pump housing, and the swash plate is also tilted to a small tilt angle by a pressing unit such as a control piston that operates in accordance with an input pressure. As the tilt angle of the swash plate is larger, the flow rate of the fluid discharged from the hydraulic pump is larger.

In the conventional hydraulic pump disclosed in the '948 Publication, when the engine is started, the control piston receives no pressure and thus the tilt angle of the swash plate is the maximum. That is, the torque required for driving the hydraulic pump is the maximum. In this state, a large drive force is needed to start driving the hydraulic pump by starting the engine. In particular, the fluid has a higher viscosity in a low-temperature environment, and the driving torque required for starting the engine is significantly larger. Therefore, when the hydraulic pump is used in a low-temperature environment, it needs to have a large-sized battery and starter motor for starting the engine.

SUMMARY

The present invention addresses the above drawback, and one object thereof is to provide a hydraulic pump that allows a drive source to be started with a small torque. A hydraulic pump of the present invention comprises: a cylinder block having a plurality of cylinder bores and disposed so as to be rotatable; a plurality of pistons each retained in associated one of the plurality of cylinder bores so as to be movable; a swash plate for controlling an amount of movement of the plurality of pistons in accordance with a size of a tilt angle of the swash plate; a first pressing unit for pressing the swash plate in such a direction as to reduce the tilt angle of the swash plate; and a second pressing unit for pressing the swash plate in such a direction as to increase the tilt angle of the swash plate by a pressure supplied from an outside.

The hydraulic pump of the present invention may be configured such that the second pressing unit includes a pressing rod for pressing the swash plate in such a direction as to increase the tilt angle of the swash plate, and the pressure acts on an end surface of the pressing rod opposite to the swash plate.

The hydraulic pump of the present invention may be configured such that the pressure is a pressure corresponding to a negative flow control pressure.

The hydraulic pump of the present invention may be configured such that the pressure is a pressure corresponding to a load-sensing flow control pressure.

The hydraulic pump of the present invention may be configured such that the pressure is a pressure corresponding to a positive flow control pressure.

The hydraulic pump of the present invention may be configured such that the pressure is a pressure corresponding to a lock lever pressure.

The hydraulic pump of the present invention may be configured such that the pressure is a fluid pressure converted from an electric signal by an electromagnetic proportional valve.

Advantages

The present invention makes it possible to provide a hydraulic pump that allows a drive source to be started with a small torque.

BRIEF DESCRIPTION OF THE DRAWINGS

FIG. 1 shows a section of a hydraulic pump with a swash plate at the minimum tilt angle.

DESCRIPTION OF THE PREFERRED EMBODIMENTS

One embodiment of the invention will be hereinafter described with reference to the attached drawings. In the attached drawings, the dimensions and the aspect ratios may be appropriately altered for emphasis, so as to facilitate illustration and comprehension of the drawings.

Moreover, terms, values, and so on used herein to specify a shape, a geometric condition, and an extent thereof, such as terms "parallel," "perpendicular," and "equal" and values of a length and an angle, are not bound to a strict meaning thereof but should be interpreted as covering a range that can be expected to achieve similar functionality.

Figure 1:
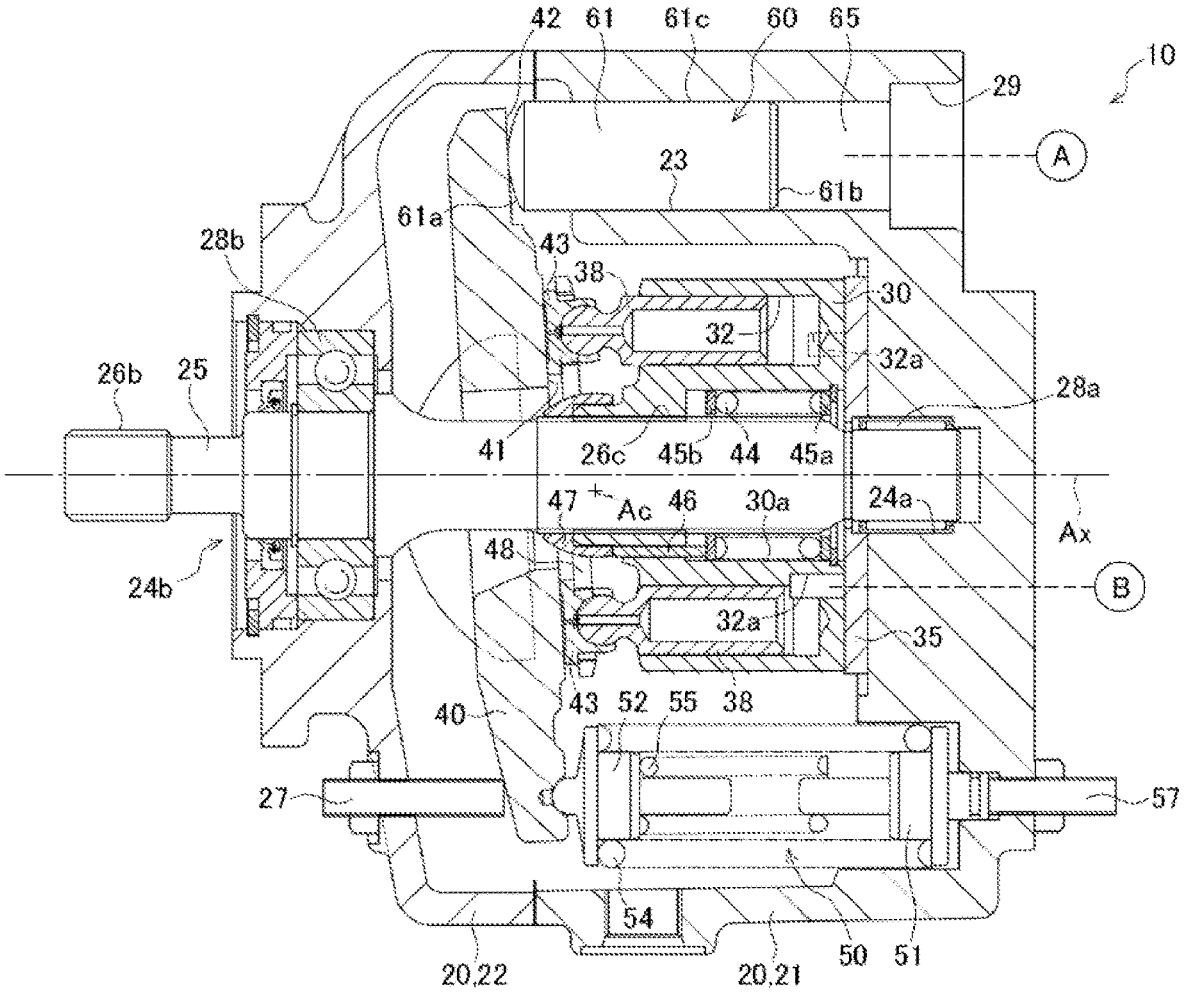
FIG. 1 explains one embodiment of the invention. In particular.
Figure 2:
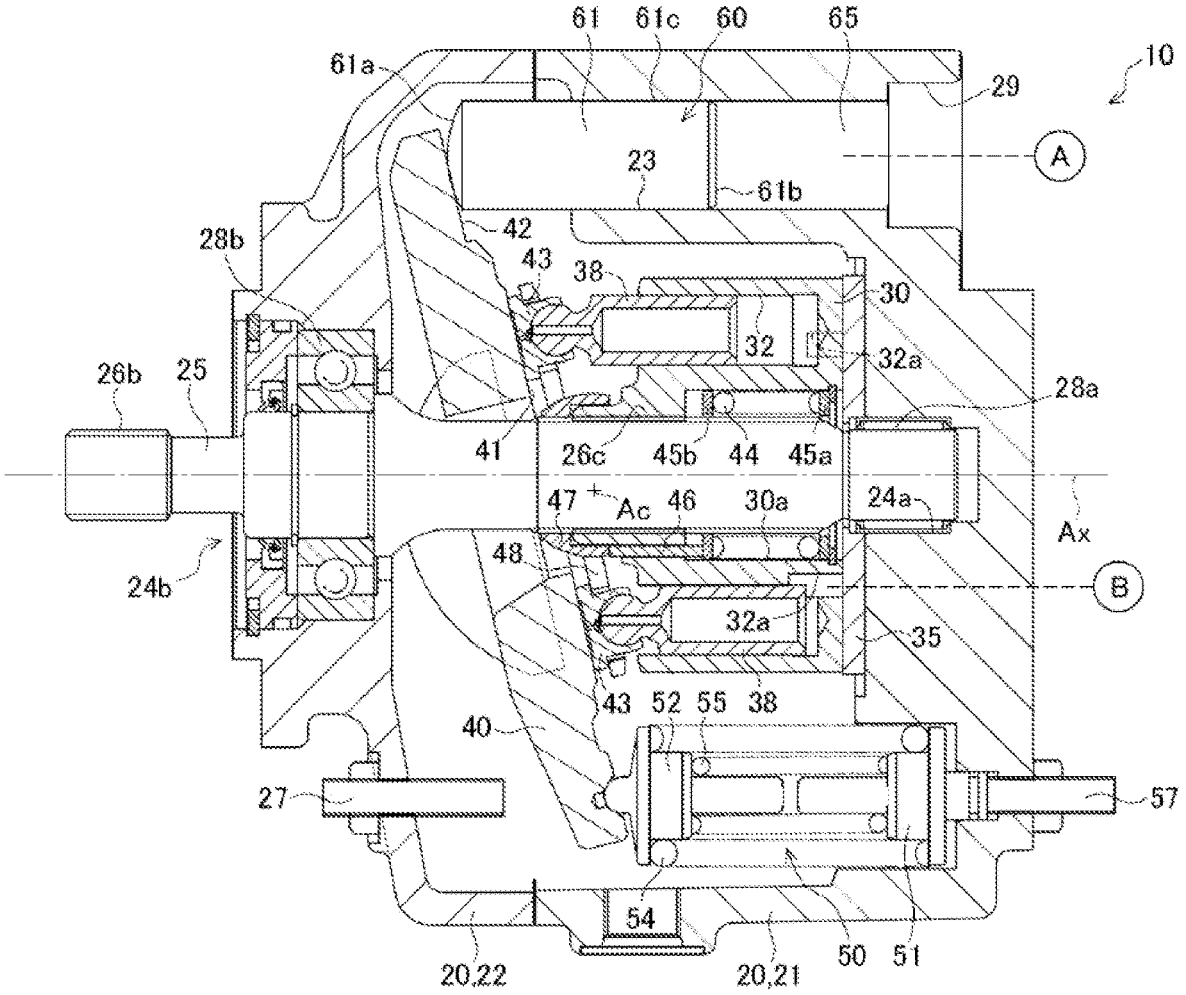
FIG. 2 shows a section of the hydraulic pump of FIG. 1 with the swash plate at the maximum tilt angle.

FIGS. 1 to 8B explain one embodiment of the invention. Among them, FIGS. 1 and 2 show a section of a hydraulic pump 10. In particular, FIG. 1 shows a section of the hydraulic pump 10 with a swash plate 40 (described later) at the minimum tilt angle, and FIG. 2 shows a section of the hydraulic pump 10 with the swash plate 40 at the maximum tilt angle.

The hydraulic pump 10 of the embodiment is what we call a swash plate type variable displacement hydraulic pump. The hydraulic pump 10 outputs a drive force based on discharge of a fluid from cylinder bores 32 (described later) (and suck of the fluid into the cylinder bores 32). More specifically, the power from a power source such as an engine rotates a rotary shaft 25, causing rotation of a cylinder block 30 connected with the rotary shaft 25 by spline connection or the like. The rotation of the cylinder block 30 causes pistons 38 to reciprocate. In accordance with the reciprocation of the pistons 38, the fluid is discharged from some cylinder bores 32 and also sucked into the other cylinder bores 32, thereby accomplishing the operation of the hydraulic pump.

The hydraulic pump 10 shown in FIGS. 1 and 2 includes a housing 20, the rotary shaft 25, the cylinder block 30, the swash plate 40, and a first pressing unit 50 and a second pressing unit 60.

The housing 20 includes a first housing block 21 and a second housing block 22 connected to the first housing block 21 with a fastener not shown. The housing 20 houses a part of the rotary shaft 25, the cylinder block 30, the swash plate 40, and the first pressing unit 50. In the example shown in FIGS. 1 and 2, there are provided inside the first housing block 21, one end portion of the rotary shaft 25, a suction port and a discharge port (not shown) that communicate with a plurality of cylinder bores 32 via a pumping plate 35, and a first guide portion 23 for guiding a pressing rod 61 described later. The suction port extends through the first housing block 21 and communicates with a fluid source (a tank) provided outside the hydraulic pump 10.

The first housing block 21 has a rotary shaft-receiving recess 24*a* that receives the rotary shaft 25 therein, and the rotary shaft 25 is supported by a bearing 28*a* in the rotary shaft-receiving recess 24*a* so as to be rotatable about an axis (a rotational axis) Ax. The axis Ax extends along the longitudinal direction of the rotary shaft 25.

The second housing block 22 has a rotary shaft-receiving hole 24*b* penetrated by the rotary shaft 25, and the rotary shaft-receiving hole 24*b* extends from the one end thereof toward the other end through the cylinder block 30 and the swash plate 40. The rotary shaft 25 is supported at the other end thereof by a bearing 28*b* disposed in the rotary shaft-receiving hole 24*b* so as to be rotatable about the axis Ax. In the example shown, the other end of the rotary shaft 25 projects outward from the rotary shaft-receiving hole 24*b*, and is connected with the power source such as an engine via a spline connection unit 26*b* formed on the other end. This is not limitative, and it is also possible that the other end of the rotary shaft 25 does not project outward from the rotary shaft-receiving hole 24*b*. Specifically, the other end of the rotary shaft 25 may be positioned inside the housing 20. For example, a drive shaft extending from the power source may be inserted into the housing 20 such that the drive shaft is connected with the other end of the rotary shaft 25 in the housing 20.

In the example shown in FIGS. 1 and 2, the rotary shaft 25 is spline-connected with the cylinder block 30 at the spline connection unit 26*c* provided at a portion where the rotary shaft 25 penetrates the cylinder block 30. The spline connection with the cylinder block 30 makes the rotary shaft 25 movable in the direction of the axis Ax independently of the cylinder block 30, while the rotary shaft 25 rotates in the rotational direction about the axis Ax integrally with the cylinder block 30. The rotary shaft 25 is supported by a bearing 28*a* in the first housing block 21 so as to be rotatable, and is supported by the bearing 28*b* in the second housing block 22 so as to be rotatable and restricted in movement along the axis Ax. The rotary shaft 25 is arranged not to contact with the swash plate 40. Accordingly, the rotary shaft 25 can rotate in the rotational direction about the axis Ax along with the cylinder block 30 without being inhibited by members other than the cylinder block 30.

The cylinder block 30 is arranged to be rotatable about the axis Ax along with the rotary shaft 25, and the cylinder block 30 has the plurality of cylinder bores 32 drilled around the axis Ax. In the example shown in FIGS. 1 and 2 in particular, each of the cylinder bores 32 is provided so as to extend along the direction parallel to the axis Ax. This is not limitative, and it is also possible that the cylinder bores 32 are provided so as to extend along the direction oblique to the axis Ax. The number of cylinder bores 32 provided in the cylinder block 30 is not limited, but these cylinder bores 32 are preferably arranged in the same circumference at regular intervals (regular angular intervals) as viewed from the direction along the axis Ax.

In an end portion of the cylinder block 30 opposite to the swash plate 40, there are provided openings 32*a* that each communicate with associated one of the plurality of cylinder bores 32. The pumping plate 35 is provided to face the end portion of the cylinder block 30 opposite to the swash plate 40. The pumping plate 35 has a plurality of through-holes formed therein. The plurality of cylinder bores 32 communicate with the suction port and the discharge port (not shown) provided in the first housing block 21 via the openings 32*a* and the through-holes, and the fluid is sucked and discharged via the suction port and the discharge port. In the example shown in FIGS. 1 and 2, a recess 30*a* that receives a spring 44 and retainers 45*a*, 45*b* (described later) is provided in the end portion of the cylinder block 30 opposite to the swash plate 40 so as to encircle the rotary shaft 25.

The pumping plate 35 shown in FIGS. 1 and 2 is fixed to the first housing block 21 and is stationary with respect to the housing 20 (the first housing block 21) even when the cylinder block 30 rotates along with the rotary shaft 25. Therefore, the cylinder bores 32 that communicate with each of the suction port and the discharge port are switched via the pumping plate 35 in accordance with the rotation status of the cylinder block 30, thereby alternating between the state where the fluid is sucked in from the suction port and the state where the fluid is discharged to the discharge port.

Each of the pistons 38 is arranged so as to be movable with respect to the associated cylinder bore 32. In other words, each of the pistons 38 is retained in the associated cylinder bore 32 so as to be movable. In particular, each of the pistons 38 is capable of reciprocating along the direction parallel with the axis Ax with respect to the associated cylinder bore 32. The interior of the piston 38 is hollow and filled with the fluid in the cylinder bore 32. Accordingly, the reciprocation of the piston 38 is associated with the suction and discharge of the fluid into and out of the cylinder bore 32. When the piston 38 is drawn out of the cylinder bore 32, the fluid is sucked into the cylinder bore 32 from the suction port, and when the piston 38 is advanced into the cylinder bore 32, the fluid is discharged from the cylinder bore 32 into the discharge port.

In the embodiment, each of the pistons 38 has a shoe 43 mounted to an end portion thereof facing the swash plate 40 (the end portion that projects from the cylinder bore 32). Around the rotary shaft 25, there are provided the spring 44, the retainers 45*a*, 45*b*, a connection member 46, a pressing member 47, and a shoe retaining member 48. The spring 44 and the retainers 45*a*, 45*b* are received in the recess 30*a*, the recess 30*a* being provided in the end portion of the cylinder block 30 opposite to the swash plate 40 so as to encircle the rotary shaft 25. In the example shown in FIGS. 1 and 2, the spring 44 is constituted by a coil spring and disposed in the recess 30*a* so as to be compressed between the retainer 45*a* and the retainer 45*b*. Accordingly, the spring 44 produces a pressing force in the direction in which the spring 44 expands by the elastic force thereof. The pressing force of the spring 44 is transmitted to the pressing member 47 via the retainer 45*b* and the connection member 46. The shoe retaining member 48 retains the shoes 43, and the pressing member 47 that receives the pressing force of the spring 44 presses the shoes 43 via the shoe retaining member 48 toward the swash plate 40.

In the example shown in FIGS. 1 and 2, the swash plate 40 can be tilted to various angles, and the shoes 43 are pressed against the swash plate 40 so as to conform to any tilt angle of the swash plate 40. Thus, when the pistons 38 rotate along with the cylinder block 30, the shoes 43 move on the swash plate 40 in a circular orbit. In the example shown, the end portion of each piston 38 facing the swash plate 40 forms a spherical convex portion, the spherical convex portion of the piston 38 is fitted in a spherical concave portion provided in the associated shoe 43, the concave portion of the shoe 43 is caulked, and thus the piston 38 and the shoe 43 form a spherical bearing structure. The spherical bearing structure allows the shoes 43 to rotationally move on the swash plate 40 so as to conform to the varying tilt angle of the swash plate 40.

The swash plate 40 controls the amount of movement of the pistons 38 in accordance with the size of the tilt angle thereof. More specifically, the swash plate 40 causes the pistons to move in the cylinder bores 32 as the cylinder block 30 rotates about the axis Ax. The swash plate 40 has a flat primary surface 41 on the side facing the cylinder block 30, and the primary surface 41 receives the shoes 43 each connected with the end portion of the piston 38 facing the swash plate 40 and each pressed against the primary surface 41. The swash plate 40 can be tilted at a varying tilt angle, and the pistons 38 reciprocate with different strokes in accordance with the tilt angle of the swash plate 40 (the primary surface 41). More specifically, as the tilt angle of the swash plate 40 (the primary surface 41) is larger, a larger amount of fluid is sucked into and discharged from the cylinder bores 32 upon the reciprocation of the pistons 38, while as the tilt angle of the swash plate 40 (the primary surface 41) is smaller, a smaller amount of fluid is sucked into and discharged from the cylinder bores 32 upon the reciprocation of the pistons 38. The tilt angle of the swash plate 40 (the primary surface 41) refers to an angle contained between the plate surface (the primary surface 41) of the swash plate 40 and a virtual plane perpendicular to the axis Ax. When the tilt angle is zero degrees, the pistons 38 do not reciprocate upon rotation of the cylinder block 30 about the axis Ax, such that the amount of the fluid discharged from the cylinder bores 32 is zero. As shown in FIG. 1, when the tilt angle of the swash plate 40 is reduced, the swash plate 40 contacts with a stopper 27 provided on the second housing block 22. The stopper 27 is capable of advancing and retracting with respect to the swash plate 40. Thus, the minimum tilt angle of the swash plate 40 can be adjusted appropriately by advancing or retracting the stopper 27 with respect to the swash plate 40. The swash plate 40 has an action surface 42 in the outer side of the primary surface 41, the action surface 42 being configured to be contacted by the pressing rod 61 (described later) and acted on by a pressing force imparted by the pressing rod 61. In the example shown, the action surface 42 is parallel with the primary surface 41.

The first pressing unit 50 presses the swash plate 40 in such a direction as to reduce the tilt angle of the swash plate 40. In the example shown in FIGS. 1 and 2, the first pressing unit 50 includes a first retainer 51 disposed on the opposite side to the swash plate 40 (on the side facing the first housing block 21), a second retainer 52 disposed on the side facing the swash plate 40 (on the side facing the second housing block 22), and springs 54, 55 disposed between the first retainer 51 and the second retainer 52. The first spring 54 is compressed between the first retainer 51 and the second retainer 52. Accordingly, the first spring 54 produces a pressing force in the direction in which the first spring 54 expands by the elastic force thereof. The second spring 55 is disposed inside the first spring 54. Therefore, the winding diameter of the second spring 55 is smaller than that of the first spring 54.

In the example shown in FIGS. 1 and 2, the second spring 55 is fixed to the second retainer 52 and configured to separate from the first retainer 51 in the state where the tilt angle of the swash plate is small (see FIG. 1). Thus, when the tilt angle of the swash plate 40 is small, the swash plate 40 is acted on only by the pressing force of the first spring 54. When the tilt angle of the swash plate 40 is increased to a given tilt angle, the second spring 55 contacts with the first retainer 51. With a further increased tilt angle of the swash plate 40 (see FIG. 2), the second spring 55 is also compressed between the first retainer 51 and the second retainer 52, and therefore, the swash plate 40 is acted on by both the pressing forces of the first spring 54 and the second spring 55. Accordingly, the first pressing unit 50 shown varies the pressing force thereof stepwise in accordance with the tilt angle of the swash plate 40. The second spring 55 is not necessarily fixed to the second retainer 52 but may be fixed to the first retainer 51 or fixed to neither the first retainer 51 nor the second retainer 52 so as to be movable between the first retainer 51 and the second retainer 52. In the example shown, the distance between the first retainer 51 and the second retainer 52 can be adjusted by advancing or retracting an adjuster 57 toward or from the first retainer 51. Thus, it is possible to adjust appropriately the initial pressing force of the first pressing unit 50, or particularly the initial pressing force of the first pressing unit 50 produced by the first spring 54. In the embodiment, the second spring 55 provides an additional pressing force to the first spring 54. Accordingly, it is possible to omit the second spring 55 depending on the pressing force characteristics the first pressing unit 50 is expected to exercise.

The second pressing unit 60 imparts a pressing force to the swash plate 40 in a direction opposite to the direction of the pressing force of the first pressing unit 50 imparted to the swash plate 40. Specifically, the second pressing unit 60 presses the swash plate 40 in such a direction as to increase the tilt angle of the swash plate 40, against the pressing force of the first pressing unit 50 imparted in such a direction as to reduce the tilt angle of the swash plate 40. In the example shown in FIGS. 1 and 2, the second pressing unit 60 includes the pressing rod 61 and a pressure chamber 65 provided on the side of the pressing rod 61 opposite to the swash plate 40. The pressure chamber 65 receives a pressure input (introduced) from the outside. The word "outside" herein refers to the outside of the fluid pump 10. The pressing rod 61 is pressed toward the swash plate 40 by the pressure input to the pressure chamber 65 and causes the swash plate 40 to tilt about the tilt axis thereof to a larger tilt angle. Thus, the second pressing force 60 is controlled by the pressure input to the second pressing unit 60 (the pressure chamber 65).

In the example shown in FIGS. 1 and 2, the pressing rod 61 as a whole has a substantially cylindrical shape, and is disposed to face the action surface 42 of the swash plate 40 such that the axis thereof is parallel with the axis Ax. The axis of the pressing rod 61 is not necessarily parallel with the axis Ax but may be oblique to the axis Ax. The pressing rod 61 includes a front end surface 61*a* that faces the swash plate 40 (the action surface 42), a rear end surface (an end surface) 61*b* that is opposite to the front end surface 61*a* along the axis of the pressing rod 61, and a side surface 61*c* that connects between the front end surface 61*a* and the rear end surface 61*b*. In the example shown, the front end surface 61*a* has a spherical shape. Thus, even when the tilt angle of the swash plate 40 is varied and thus the angle contained between the swash plate 40 (the action surface 42) and the pressing rod 61 is varied, the pressing force to be imparted to the swash plate 40 can be appropriately transmitted from the front end surface 61*a* to the action surface 42. The rear end surface 61*b* of the pressing rod 61 has a flat surface that is perpendicular to the axis of the pressing rod 61. The rear end surface 61*b* may have any arrangement and shape as long as it can serve as an action surface acted on by the pressure. The term "rear end surface" refers to a surface that faces substantially opposite to the "front end surface." Accordingly, the rear end surface 61*b* is not necessarily a surface positioned at the rearmost end of the pressing rod 61. For example, the rear end surface 61*b* may be provided in the middle portion of the pressing rod 61 along the axis thereof. Further, the rear end surface 61*b* may have a flat surface oblique to the axis of the pressing rod 61 or include a curved surface. For example, the rear end surface 61*b* may be a spherical surface projecting from the pressing rod 61, a spherical surface concaved toward the pressing rod 61, a wavy surface, a composite surface including a plurality of flat surfaces, a composite surface including a plurality of curved surfaces, a composite surface including flat surfaces and curved surfaces, or a stepped surface.

The first housing block 21 (the housing 20) has a first guide portion 23 for guiding the side surface 61*c* of the pressing rod 61, and the pressing rod 61 is movable with respect to the first guide portion 23. Therefore, a part of the pressing rod 61 is retained in the first guide portion 23 so as to be movable. The first guide portion 23 is constituted by a through-hole provided in the first housing block 21 and has a cross-sectional shape complementary to the cross-sectional shape of the pressing rod 61. More specifically, the first guide portion 23 is constituted by a cylindrical through-hole having a circular cross-section. In the example shown in FIGS. 1 and 2, the first guide portion 23 is integral with the first housing block 21 (the housing 20). Since the first guide portion 23 is integral with the first housing block 21, the first guide portion 23 can be formed simply by drilling the first housing block 21. In addition, no additional member is needed to provide the first guide portion 23, resulting in reduction of the number of parts of the hydraulic pump 10 and the costs. The first guide portion 23 is not necessarily configured as described above. By way of an example, the first guide portion 23 may be formed of a member separate from the first housing block 21 and having a cylindrical shape for example, and mounted to the housing 20.

The first housing block 21 (the housing 20) has a recess 29 that communicates with the first guide portion 23. The recess 29 receives a lid member (not shown) fitted therein, and the lid member closes the pressure chamber 65. By way of an example, the lid member may be the pressing pin unit disclosed in Japanese Patent Application Publication No. 2018-003609A ("the '609 Publication"). In this case, the recess 29 receives a convex portion of the pressing pin unit fitted therein.

When the pressing rod 61 presses the swash plate 40, the pressing rod 61 may receive a force acting thereon in a direction oblique to the axis of the pressing rod 61. In the hydraulic pump 10 of the embodiment, the first guide portion 23 retains the pressing rod 61 appropriately even when the pressing rod 61 receives a force acting thereon in a direction oblique to the axis of the pressing rod 61, and therefore, the pressing rod 61 can operate stably. In addition, a part of the fluid retained in the housing 20 is supplied between the side surface 61*c* of the pressing rod 61 and the first guide portion 23, so as to accomplish lubrication between the side surface 61*c* and the first guide portion 23.

The pressure chamber 65 is provided on the side of the pressing rod 61 opposite to the swash plate 40. In the embodiment, the pressure chamber 65 is constituted by a space formed between the rear end surface 61*b* of the pressing rod 61 and the lid member. The pressure chamber 65 receives a pressure input through the fluid, and this pressure acts on the rear end surface 61*b* of the pressing rod 61. In the embodiment, the pressure acts directly on the rear end surface 61*b* of the pressing rod 61. The phrase "acts directly" refers to the pressure acting on the rear end surface 61*b* of the pressing rod 61 without any medium of other members. This is not limitative, and the pressure may act on the pressing rod 61 via the bias pin disclosed in the '609 Publication.

In FIGS. 1 and 2, the axis Ac at the center of tilting of the swash plate 40 extends vertically to the drawing. Accordingly, as viewed from the direction perpendicular to both the axis Ax and the axis Ac (the upward direction or the downward direction in FIGS. 1 and 2), the axis Ax and the axis Ac extend perpendicular to each other. In the example shown, the axis Ac is positioned closer to the first pressing unit 50 with respect to the axis Ax. This arrangement makes it possible to downsize the second pressing unit 60 as compared to the case where the axis Ac intersects the axis Ax (the axis Ac and the axis Ax share one point).

Next, one example of the pressure input to the second pressing unit 60 will be described with reference to FIGS. 3A and 3B. In the example shown, the pressure input to the second pressing unit 60 (the pressure supplied from the outside) is the pressure corresponding to a negative flow control pressure $P_N$. The portions denoted by the signs A and B in FIGS. 3A to 8B communicate respectively with the portions denoted by the signs A and B in FIGS. 1 and 2.

When a hydraulic actuator is halted or is operating slowly, the amount of the fluid consumed by the hydraulic actuator is small, and most of the fluid discharged from the hydraulic pump 10 is discharged into the tank. In this time, the drive source such as an engine that drives the hydraulic pump 10 consumes fuel. Accordingly, during the halt or slow operation of the hydraulic actuator, it is favorable to reduce the amount of the fluid discharged from the hydraulic pump 10 and reduce the amount of fuel consumed in the drive source.

In a negative flow control (negative control) mechanism, there is provided an orifice in a center bypass line running from the hydraulic pump via a control valve to the tank, at a portion between the control valve and the tank. The leakage flow rate of the fluid passing through the orifice is sensed as a back pressure of the orifice, and the sensed back pressure constitutes the negative flow control pressure $P_N$. When the control valve is operated to reduce the flow rate of the fluid flowing via the control valve toward the hydraulic actuator for the halt or the slow operation of the hydraulic actuator, the flow rate of the fluid returned from the hydraulic pump 10 via the center bypass line to the tank in the negative flow control mechanism is increased. As a result, the pressure (back pressure) $P_N$ of the fluid yet to reach the orifice in the center bypass line is increased.

Figure 3A:
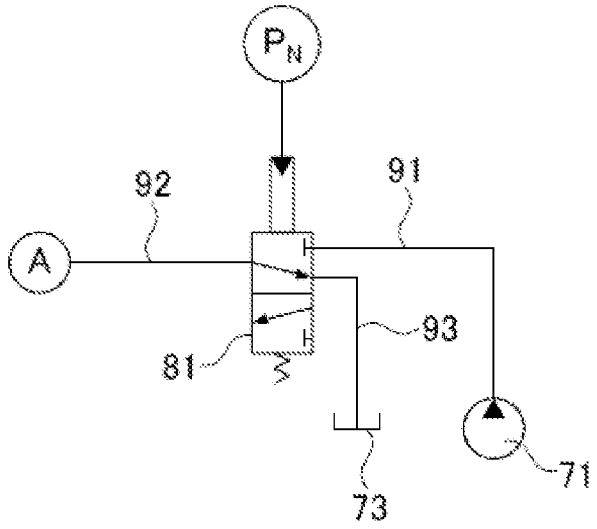
FIG. 3A explains a pressure input to a second pressing unit of the hydraulic pump.
Figure 3B:
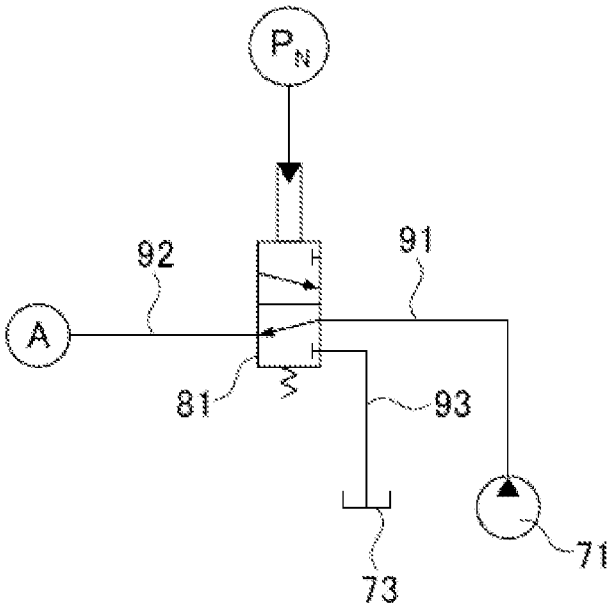
FIG. 3B explains the pressure input to the second pressing unit of the hydraulic pump.

In the example shown in FIGS. 3A and 3B, the negative flow control pressure $P_N$ is converted into a pressure corresponding to the pressure $P_N$ and input to the pressure chamber 65. More specifically, in the example shown, the pressure corresponding to the pressure $P_N$ that is input to the pressure chamber 65 is a pressure at an inverted level relative to the pressure $P_N$. The pressure corresponding to the pressure $P_N$ refers to a pressure produced based on the pressure $P_N$. In the example shown, a directional control valve 81 is used to convert the pressure $P_N$ into the pressure corresponding to the pressure $P_N$. The directional control valve 81 includes a spool and a spring for pressing the spool. The pressure $P_N$ is input to the directional control valve 81 to control the position of the spool of the directional control valve 81 so as to switch the fluid passage in the directional control valve 81.

When the pressure $P_N$ input to the directional control valve 81 is high, or when the flow rate of the fluid passing through the center bypass line of the negative flow control mechanism and discharged into the tank is high, the spool of the directional control valve 81 is displaced by the pressure $P_N$ against the pressing force of the spring, and as shown in FIG. 3A, a flow passage 91 of the fluid running from a pilot pump 71 to the directional control valve 81 does not communicate with a flow passage 92 of the fluid running from the directional control valve 81 to the second pressing unit 60. In the example shown, the flow passage 92 communicates with a flow passage 93 running from the directional control valve 81 to the tank 73. In this state, the second pressing unit 60 (the pressure chamber 65) does not receive the pressure of the fluid discharged from the pilot pump 71. Accordingly, as shown in FIG. 1, the pressing rod 61 does not press the swash plate 40, resulting in a smaller tilt angle of the swash plate 40. Thus, the flow rate of the fluid discharged from the hydraulic pump 10 is reduced.

When the pressure $P_N$ input to the directional control valve 81 is low, or when the flow rate of the fluid passing through the center bypass line of the negative flow control mechanism and discharged into the tank is low, the spool of the directional control valve 81 is displaced by the pressing force of the spring, and as shown in FIG. 3B, the flow passage 91 communicates with the flow passage 92. In the example shown, the flow passage 92 does not communicate with the flow passage 93 running from the directional control valve 81 to the tank 73. In this state, the second pressing unit 60 (the pressure chamber 65) receives the pressure of the fluid discharged from the pilot pump 71. Accordingly, as shown in FIG. 2, the pressing rod 61 presses the swash plate 40, resulting in a larger tilt angle of the swash plate 40. Thus, the flow rate of the fluid discharged from the hydraulic pump 10 is increased.

The spool of the directional control valve 81 is displaced continuously between the position where the flow passage 91 and the flow passage 92 communicate fully with each other (the full-open position) and the position where the flow passage 91 and the flow passage 92 are disconnected fully from each other (the full-closed position), and the spool of the directional control valve 81 may also be situated at an intermediate position between the full-open position and the full-closed position. Thus, the degree of opening of the flow passage connecting between the flow passage 91 and the flow passage 92 in the directional control valve 81 is controlled continuously in accordance with the pressure $P_N$ input to the directional control valve 81.

In the example shown in FIGS. 3A and 3B, the pressure corresponding to the pressure $P_N$ is the pressure of the fluid discharged from the pilot pump 71, passed through the directional control valve 81 controlled by the pressure $P_N$ for adjustment of the pressure thereof, and input to the second pressing unit 60. In the example shown, as the pressure $P_N$ input to the directional control valve 81 is higher, the pressure input to the second pressing unit 60 is lower, whereas as the pressure $P_N$ input to the directional control valve 81 is lower, the pressure input to the second pressing unit 60 is higher. In other words, a pressure at an inverted level relative to the pressure $P_N$. is input to the second pressing unit 60.

When the drive source such as an engine is halted and no fluid is discharged from the hydraulic pump 10, the directional control valve 81 does not receive the pressure $P_N$ from the negative flow control mechanism. Thus, as shown in FIG. 3B, the flow passage 91 communicates with the flow passage 92. When the drive source is halted, the pilot pump 71 is also halted, and therefore, no fluid is discharged from the pilot pump 71. In this state, no pressure is input to the second pressing unit 60. Accordingly, as shown in FIG. 1, the pressing rod 61 does not press the swash plate 40, resulting in a smaller tilt angle of the swash plate 40. In particular, the tilt angle of the swash plate 40 is the minimum.

In the conventional hydraulic pump, when the engine is started, the control piston receives no pressure and thus the tilt angle of the swash plate is the maximum. That is, the torque required for driving the hydraulic pump is the maximum. In this state, a large drive force is needed to start driving the hydraulic pump by starting the engine. In particular, the fluid has a higher viscosity in a low-temperature environment, and the driving torque required for starting the engine is significantly larger. Therefore, when the hydraulic pump is used in a low-temperature environment, it needs to have a large-sized battery for starting the engine.

By contrast, in the hydraulic pump 10 shown in FIGS. 1 to 3B, the tilt angle of the swash plate 40 is smaller when starting the drive source such as an engine. That is, the torque required for driving the hydraulic pump 10 is smaller. In the example shown, the tilt angle of the swash plate 40 is the minimum when starting the drive source such as an engine. That is, the torque required for driving the hydraulic pump 10 is the minimum. Accordingly, even in a low-temperature environment where the viscosity of the fluid is high, the driving torque needed to start driving the hydraulic pump 10 can be small. Thus, the battery for starting the drive source can be downsized. This contributes to downsizing of the whole of the hydraulic drive system including the hydraulic pump 10 and the drive source. It should be noted that the tilt angle of the swash plate 40 in starting the drive source is not necessarily the minimum. If the tilt angle of the swash plate 40 in starting the drive source is smaller than the maximum, the torque required for driving the hydraulic pump 10 can be smaller. For example, the tilt angle of the swash plate 40 in starting the drive source may be smaller than a mean between the minimum tilt angle and the maximum tilt angle. In other words, the tilt angle of the swash plate 40 in starting the drive source may be smaller than the half of the sum of the minimum tilt angle and the maximum tilt angle.

The hydraulic pump 10 according to the embodiment includes: a cylinder block 30 having a plurality of cylinder bores 32 and disposed so as to be rotatable; pistons 38 each retained in associated one of the cylinder bores 32 so as to be movable; a swash plate 40 for controlling the amount of movement of the pistons 38 in accordance with the size of the tilt angle; a first pressing unit 50 for pressing the swash plate 40 in such a direction as to reduce the tilt angle of the swash plate 40; and a second pressing unit 60 for pressing the swash plate 40 in such a direction as to increase the tilt angle of the swash plate 40 by the pressure supplied from the outside.

In the above hydraulic pump 10, the second pressing unit 60 controlled by the pressure supplied from the outside presses the swash plate 40 in such a direction as to increase the tilt angle of the swash plate 40, and therefore, when starting the drive source with no pressure input to the second pressing unit 60, the tilt angle of the swash plate 40 can be small. Accordingly, even in a low-temperature environment where the viscosity of the fluid is high, the driving torque needed to start driving the hydraulic pump 10 can be small.

In the hydraulic pump 10 according to the embodiment, the second pressing unit 60 includes the pressing rod 61 for pressing the swash plate 40 in such a direction as to increase the tilt angle of the swash plate 40, and the pressure supplied from the outside acts on the end surface 61*b* of the pressing rod 61 opposite to the swash plate 40.

In the hydraulic pump 10 as described above, the second pressing unit 60 can have relatively simple structure, making it possible to reduce the number of parts and downsize the hydraulic pump 10.

In the hydraulic pump 10 according to the embodiment, the pressure supplied from the outside is the pressure corresponding to the negative flow control pressure $P_N$.

In the hydraulic pump 10 as described above, the pressing force of the second pressing unit 60 is reduced during the halt or slow operation of the hydraulic actuator. Accordingly, the swash plate 40 tilts so as to reduce the tilt angle thereof, and the flow rate of the fluid discharged from the hydraulic pump 10 is reduced. Thus, it is possible to reduce the waste of the fuel consumed in the drive source and efficiently improve the energy saving performance of a hydraulic machine including the hydraulic pump 10.

The foregoing embodiment is susceptible of various modifications. Variations will be hereinafter described with reference to the appended drawings. In the following description and the drawings used therein, parts that can be configured in a similar manner to those in the foregoing embodiment are denoted by the same reference signs as those in the foregoing embodiment, and duplicate descriptions thereof are omitted.

Figure 4A:
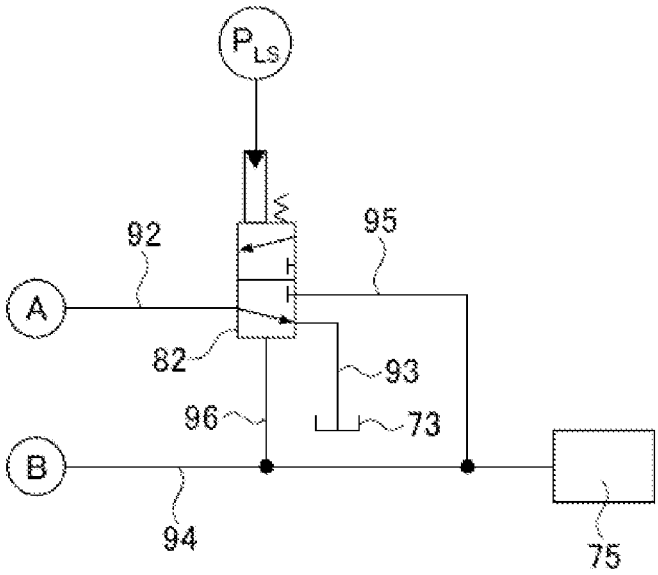
FIG. 4A shows a variation of the hydraulic pump and explains the pressure input to the second pressing unit of the hydraulic pump.
Figure 4B:
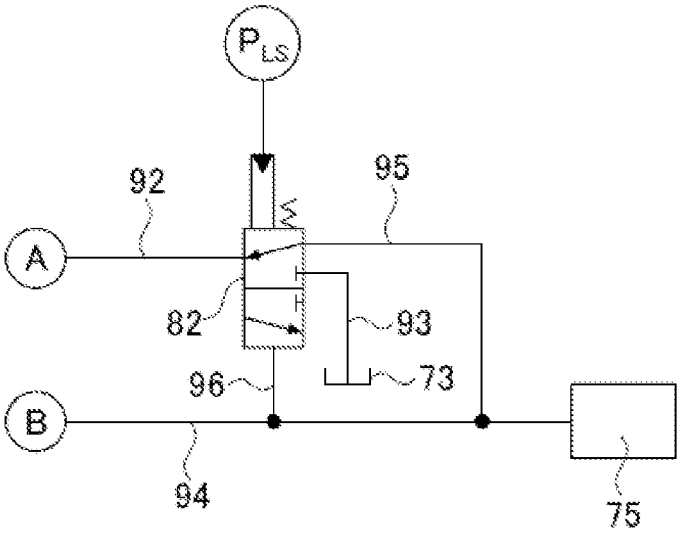
FIG. 4B explains, along with FIG. 4A, the pressure input to the second pressing unit of the hydraulic pump.

FIGS. 4A and 4B show a variation of the hydraulic pump 10 and explain the pressure input to the second pressing unit 60 of the hydraulic pump 10. In the example shown, the pressure input to the second pressing unit 60 (the pressure supplied from the outside) is the pressure corresponding to a load-sensing (LS) flow control pressure $P_{LS}$.

In the example shown, a flow passage 95 branching off from the flow passage 94 connecting between the hydraulic pump 10 and the control valve 75 is connected to the directional control valve 82. The fluid discharged from the cylinder bores 32 of the hydraulic pump 10 by operation of the hydraulic pump 10 flows through the flow passage 94 to the control valve 75 and further flows from the control valve 75 to each hydraulic actuator. A part of the fluid discharged from the hydraulic pump 10 (the cylinder bores 32) flows through the flow passage 95 branching off from the flow passage 94 and flows to the directional control valve 82. In addition, a flow passage 96 branching off from the flow passage 94 is connected to an end portion of the directional control valve 82 (the lower end portion shown in FIGS. 4A and 4B) opposite to the end portion to which the load-sensing flow control pressure $P_{LS}$ is input (the lower end portion is hereinafter referred to also as "the opposite end portion"). Thus, the opposite end portion of the directional control valve 82 is acted on by the pressure of the fluid discharged from the cylinder bores 32 of the hydraulic pump 10 and passing through the flow passages 94, 96.

In the load-sensing flow control mechanism, when the amount of the fluid consumed in the hydraulic actuator is smaller than the amount of the fluid discharged from the hydraulic pump 10, the directional control valve 82 receives a relatively small load-sensing flow control pressure $P_{LS}$, as shown in FIG. 4A. In the example shown in FIGS. 4A and 4B, the pressure $P_{LS}$ is converted into a pressure corresponding to the pressure $P_{LS}$ and input to the pressure chamber 65. More specifically, in the example shown, the pressure corresponding to the pressure $P_{LS}$ that is input to the pressure chamber 65 is a pressure at a level corresponding to the level of the pressure $P_{LS}$.

When the pressure $P_{LS}$ input to the directional control valve 82 is relatively low, the spool of the directional control valve 82 is displaced by the pressure of the fluid acting on the opposite end portion of the directional control valve 82 against the pressure $P_{LS}$ and the pressing force of the spring, and as shown in FIG. 4A, the flow passage 95 of the fluid running from the cylinder bores 32 to the directional control valve 82 does not communicate with the flow passage 92 of the fluid running from the directional control valve 82 to the second pressing unit 60. In the example shown, the flow passage 92 communicates with the flow passage 93 running from the directional control valve 82 to the tank 73. In this state, the second pressing unit 60 does not receive the pressure of a part of the fluid discharged from the cylinder bores 32 of the hydraulic pump 10 and flowing to the control valve 75. Accordingly, as shown in FIG. 1, the pressing rod 61 does not press the swash plate 40, resulting in a smaller tilt angle of the swash plate 40. Thus, the flow rate of the fluid discharged from the hydraulic pump 10 is reduced.

When the pressure $P_{LS}$ input to the directional control valve 82 is relatively high, the spool of the directional control valve 82 is displaced by the pressure $P_{LS}$ and the pressing force of the spring against the pressure of the fluid acting on the opposite end portion of the directional control valve 82, and as shown in FIG. 4B, the flow passage 95 communicates with the flow passage 92. In the example shown, the flow passage 92 does not communicate with the flow passage 93 running from the directional control valve 82 to the tank 73. In this state, the second pressing unit 60 receives the pressure of a part of the fluid discharged from the cylinder bores 32 of the hydraulic pump 10 and flowing to the control valve 75. Accordingly, as shown in FIG. 2, the pressing rod 61 presses the swash plate 40, resulting in a larger tilt angle of the swash plate 40. Thus, the flow rate of the fluid discharged from the hydraulic pump 10 is increased.

When the drive source such as an engine is halted and no fluid is discharged from the hydraulic pump 10 (the cylinder bores 32), no pressure is input from the flow passage 95 to the flow passage 92, irrespective of the position of the spool in the direction control valve 82. That is, no pressure is input to the second pressing unit 60. In this state, as shown in FIG. 1, the pressing rod 61 does not press the swash plate 40, resulting in a smaller tilt angle of the swash plate 40. In particular, the tilt angle of the swash plate 40 is the minimum.

Figure 5A:
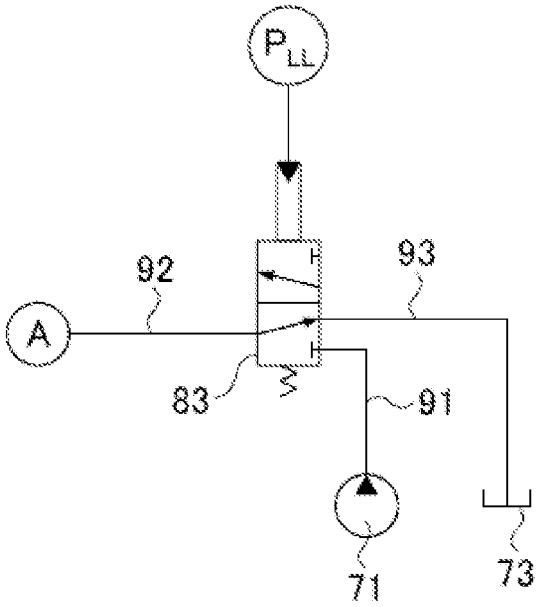
FIG. 5A shows another variation of the hydraulic pump and explains the pressure input to the second pressing unit of the hydraulic pump.

FIGS. 5A and SB show another variation of the hydraulic pump 10 and explain the pressure input to the second pressing unit 60 of the hydraulic pump 10.

A hydraulic machine may include a lock lever for locking the operation of a plurality of hydraulic actuators in a lump. In the example shown, the pressure input to the second pressing unit 60 (the pressure supplied from the outside) is the pressure corresponding to a lock lever pressure $P_{LL}$ produced by the operation of the lock lever.

Figure 5B:
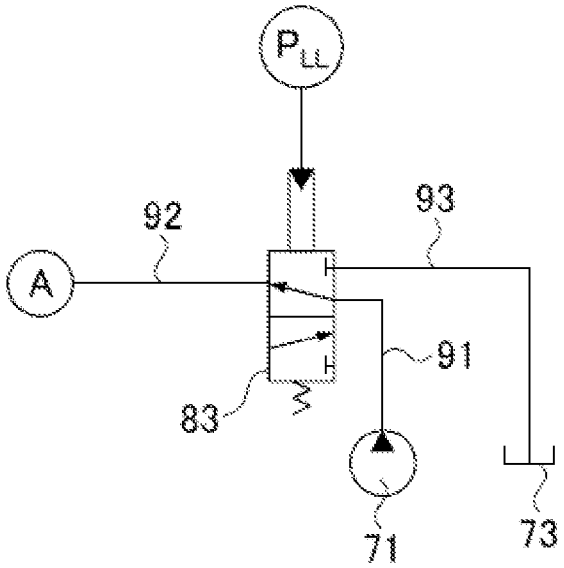
FIG. 5B explains, along with FIG. 5A, the pressure input to the second pressing unit of the hydraulic pump.

In the example shown in FIGS. 5A and 5B, the lock lever pressure $P_{LL}$ is converted into a pressure corresponding to the pressure $P_{LL}$ and input to the pressure chamber 65. More specifically, in the example shown, the pressure corresponding to the pressure $P_{LL}$ that is input to the pressure chamber 65 is a pressure at an inverted level relative to the pressure $P_{LL}$. In the example shown, a directional control valve 83 is used to convert the pressure $P_{LL}$ into the pressure corresponding to the pressure $P_{LL}$. The directional control valve 83 includes a spool and a spring for pressing the spool. The pressure $P_{LL}$ is input to the directional control valve 83 to control the position of the spool of the directional control valve 83 so as to switch the fluid passage in the directional control valve 83.

When the operation of the hydraulic actuator is locked by the lock lever and the pressure $P_{LL}$ input to the directional control valve 83 is low, the spool of the directional control valve 83 is pressed by the spring into position, and as shown in FIG. 5A, the flow passage 91 of the fluid running from the pilot pump 71 to the directional control valve 83 does not communicate with the flow passage 92 of the fluid running from the directional control valve 83 to the second pressing unit 60. In the example shown, the flow passage 92 communicates with the flow passage 93 running from the directional control valve 83 to the tank 73. In this state, the second pressing unit 60 (the pressure chamber 65) does not receive the pressure of the fluid discharged from the pilot pump 71. Accordingly, as shown in FIG. 1, the pressing rod 61 does not press the swash plate 40, resulting in a smaller tilt angle of the swash plate 40. Thus, the flow rate of the fluid discharged from the hydraulic pump 10 is reduced.

When the operation of the hydraulic actuator is unlocked by the lock lever and the pressure $P_{LL}$ input to the directional control valve 83 is high, the spool of the directional control valve 83 is displaced by the pressure $P_{LL}$ against the pressing force of the spring, and as shown in FIG. 5B, the flow passage 91 communicates with the flow passage 92. In the example shown, the flow passage 92 does not communicate with the flow passage 93 running from the directional control valve 83 to the tank 73. In this state, the second pressing unit 60 (the pressure chamber 65) receives the pressure of the fluid discharged from the pilot pump 71. Accordingly, as shown in FIG. 2, the pressing rod 61 presses the swash plate 40, resulting in a larger tilt angle of the swash plate 40. Thus, the flow rate of the fluid discharged from the hydraulic pump 10 is increased.

Figure 6A:
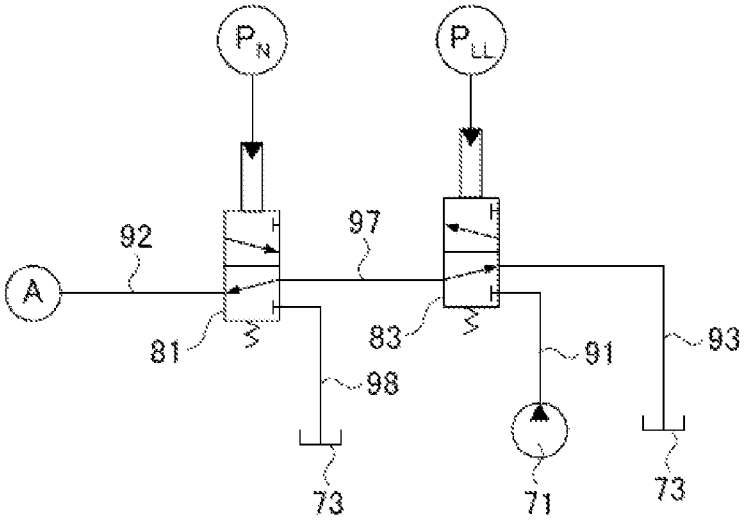
FIG. 6A shows still another variation of the hydraulic pump and explains the pressure input to the second pressing unit of the hydraulic pump.
Figure 6B:
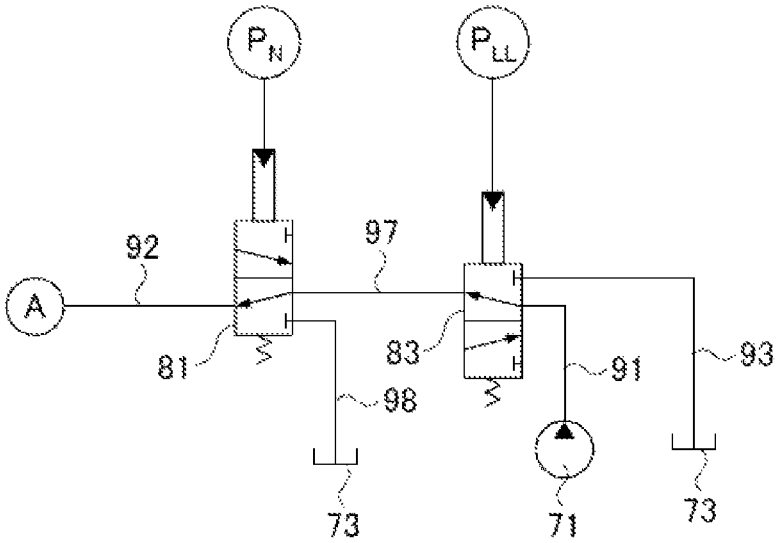
FIG. 6B explains, along with FIG. 6A, the pressure input to the second pressing unit of the hydraulic pump.
Figure 6C:
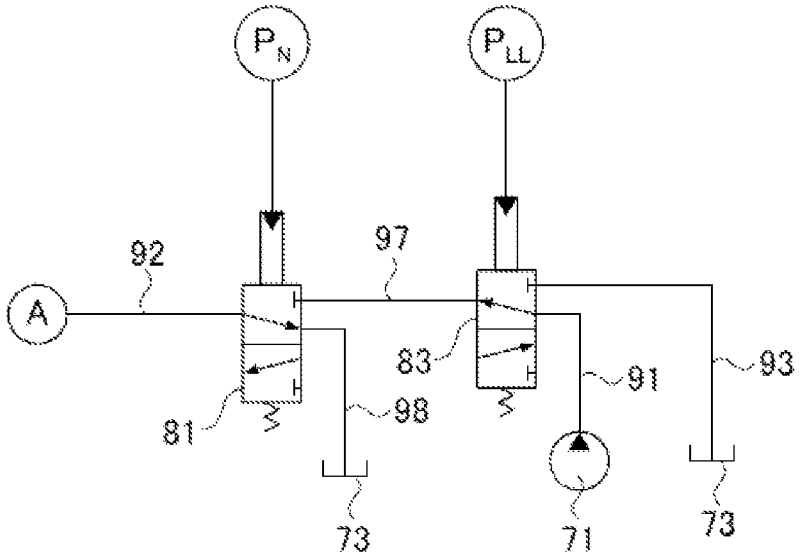
FIG. 6C explains, along with FIGS. 6A and 6B, the pressure input to the second pressing unit of the hydraulic pump.

FIGS. 6A to 6C show still another variation of the hydraulic pump 10 and explains the pressure input to the second pressing unit 60 of the hydraulic pump 10. In the example shown, the pressure input to the second pressing unit 60 is the pressure corresponding to the negative flow control pressure $P_N$ and the lock lever pressure $P_{LL}$.

When the flow rate of the fluid passing through the center bypass line of the negative flow control mechanism and discharged into the tank is low and the operation of the hydraulic actuator is locked by the lock lever, or when the pressure $P_N$ input to the directional control valve 81 is low and the pressure $P_{LL}$ input to the directional control valve 83 is also low, the spools of the directional control valves 81, 83 are pressed by the spring into position, and as shown in FIG. 6A, the flow passage 91 of the fluid running from the pilot pump 71 to the directional control valve 83 does not communicate with a flow passage 97 of the fluid running from the directional control valve 83 to the directional control valve 81. The flow passages 92, 97 of the fluid running from the directional control valve 83 to the second pressing unit 60 communicate with each other via the directional control valve 81. In the example shown, the flow passage 97 communicates with the flow passage 93 running from the directional control valve 83 to the tank 73. The flow passage 92 does not communicate with a flow passage 98 running from the directional control valve 81 to the tank 73. In this state, the second pressing unit 60 does not receive the pressure of the fluid discharged from the pilot pump 71. Accordingly, as shown in FIG. 1, the pressing rod 61 does not press the swash plate 40, resulting in a smaller tilt angle of the swash plate 40. Thus, the flow rate of the fluid discharged from the hydraulic pump 10 is reduced.

When the operation of the hydraulic actuator is unlocked by the lock lever and the pressure $P_{LL}$ input to the directional control valve 83 is high, the spool of the directional control valve 83 is displaced by the pressure $P_{LL}$ against the pressing force of the spring, and as shown in FIG. 6B, the flow passage 91 communicates with the flow passage 97. In the example shown, the flow passage 97 does not communicate with the flow passage 93. In this state, the second pressing unit 60 receives the pressure of the fluid discharged from the pilot pump 71 via the flow passages 91, 97, 92. Accordingly, as shown in FIG. 2, the pressing rod 61 presses the swash plate 40, resulting in a larger tilt angle of the swash plate 40. Thus, the flow rate of the fluid discharged from the hydraulic pump 10 is increased.

When the flow rate of the fluid passing through the center bypass line of the negative flow control mechanism and discharged into the tank is high and the pressure $P_N$ input to the directional control valve 81 is high, the spool of the directional control valve 81 is displaced by the pressure $P_N$ against the pressing force of the spring, and as shown in FIG. 6C, the flow passage 97 does not communicate with the flow passage 92. In the example shown, the flow passage 92 communicates with the flow passage 98. In this state, the second pressing unit 60 does not receive the pressure of the fluid discharged from the pilot pump 71. Accordingly, as shown in FIG. 1, the pressing rod 61 does not press the swash plate 40, resulting in a smaller tilt angle of the swash plate 40. Thus, the flow rate of the fluid discharged from the hydraulic pump 10 is reduced.

Figure 7A:
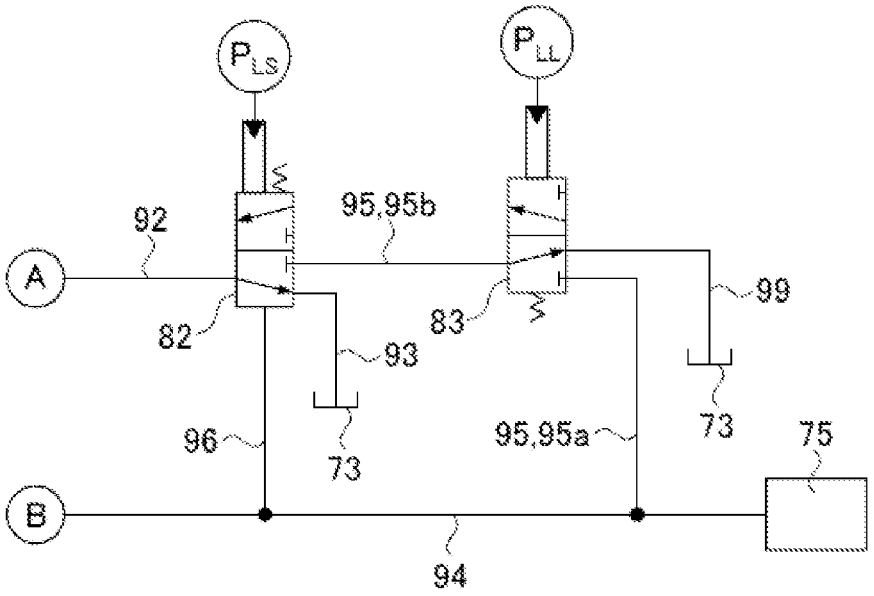
FIG. 7A shows still another variation of the hydraulic pump and explains the pressure input to the second pressing unit of the hydraulic pump.
Figure 7B:
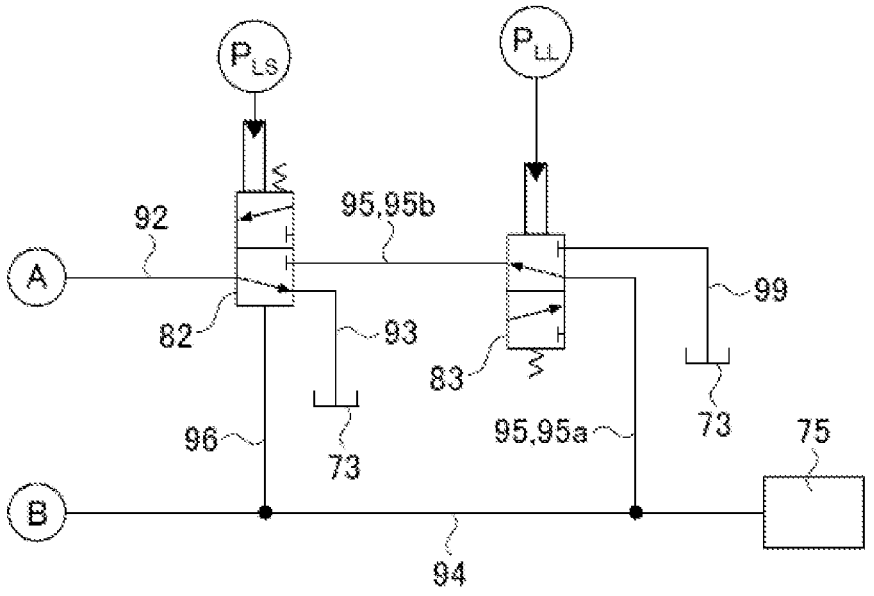
FIG. 7B explains, along with FIG. 7A, the pressure input to the second pressing unit of the hydraulic pump.

FIGS. 7A and 7B show still another variation of the hydraulic pump 10 and explain the pressure input to the second pressing unit 60 of the hydraulic pump 10. In the example shown, the pressure input to the second pressing unit 60 (the pressure supplied from the outside) is the pressure corresponding to the load-sensing flow control pressure $P_{LS}$ and the lock lever pressure $P_{LL}$. In this embodiment, the directional control valve 83 that operates by the lock lever pressure $P_{LL}$ is disposed on the flow passage 95 in the variation described above with reference to FIGS. 4A and 4B. Elements of this embodiment other than the directional control valve 83 have the same configurations, operations, and effects as in the variation described above with reference to FIGS. 4A and 4B, and therefore, detailed descriptions thereof are omitted.

In the example shown in FIGS. 7A and 7B, the directional control valve 83 is disposed on the flow passage 95, so as to divide the flow passage 95 into a flow passage 95*a* connecting between the flow passage 94 and the directional control valve 83 and a flow passage 95*b* connecting between the directional control valve 83 and the directional control valve 82.

When the operation of the hydraulic actuator is locked by the lock lever, the pressure $P_{LL}$ input to the directional control valve 83 is low. The spool of the directional control valve 83 is pressed by the spring into position, and as shown in FIG. 7A, the flow passage 95*a* branching off from the flow passage 94 and connected to the directional control valve 83 does not communicate with the flow passage 95*b* connecting between the directional control valve 83 and the directional control valve 82. In the example shown, the flow passage 95*b* communicates with a flow passage 99 running from the directional control valve 83 to the tank 73.

In the example shown in FIG. 7A, the flow passage 94 does not communicate with the flow passage 92 running from the directional control valve 82 to the second pressing unit 60, irrespective of the position of the spool in the directional control valve 82. In the example shown, the flow passage 92 communicates with the flow passage 93 running from the directional control valve 82 to the tank 73. In this state, the second pressing unit 60 does not receive the pressure of a part of the fluid discharged from the cylinder bores 32 of the hydraulic pump 10 and flowing to the control valve 75. Accordingly, as shown in FIG. 1, the pressing rod 61 does not press the swash plate 40, resulting in a smaller tilt angle of the swash plate 40. Thus, the flow rate of the fluid discharged from the hydraulic pump 10 is reduced.

When the operation of the hydraulic actuator is unlocked by the lock lever and the pressure $P_{LL}$ input to the directional control valve 83 is high, the spool of the directional control valve 83 is displaced by the pressure $P_{LL}$ against the pressing force of the spring, and as shown in FIG. 7B, the flow passage 95*a* and the flow passage 95*b* communicate with each other via the directional control valve 83. Thus, the pressure of a part of the fluid discharged from the cylinder bores 32 of the hydraulic pump 10 and flowing to the control valve 75 reaches the directional control valve 82 through the flow passage 95 (the flow passages 95*a*, 95*b*).

When the spool of the directional control valve 82 in the state shown in FIG. 7B is displaced by the pressure $P_{LS}$, the flow passage 95 (95*b*) communicates with the flow passage 92. In the example shown, the flow passage 92 does not communicate with the flow passage 93 running from the directional control valve 82 to the tank 73. In this state, the second pressing unit 60 receives the pressure of a part of the fluid discharged from the cylinder bores 32 of the hydraulic pump 10 and flowing to the control valve 75. Accordingly, as shown in FIG. 2, the pressing rod 61 presses the swash plate 40, resulting in a larger tilt angle of the swash plate 40. Thus, the flow rate of the fluid discharged from the hydraulic pump 10 is increased.

In still another variation, the pressure input to the second pressing unit 60 may be a pressure corresponding to a positive flow control (positive control) pressure PP. The pressure PP may be directly input to the pressure chamber 65 of the second pressing unit 60 or may be converted into another pressure corresponding to the pressure PP before being input to the pressure chamber 65.

A description will be herein given of an example in which the pressure PP is directly input to the pressure chamber 65 of the second pressing unit 60 without being converted into another pressure. In the positive flow control mechanism, the pilot pressure of a pilot operated valve for operating the valves is fed back to the hydraulic pump 10. In this variation, the pilot pressure is input to the second pressing unit 60 (the pressure chamber 65) as the pressure PP. When the pressure PP input to the second pressing unit 60 is low, as shown in FIG. 1, the pressing rod 61 does not press the swash plate 40, resulting in a smaller tilt angle of the swash plate 40. Thus, the flow rate of the fluid discharged from the hydraulic pump 10 is reduced. When the pressure PP input to the second pressing unit 60 is high, as shown in FIG. 2, the pressing rod 61 presses the swash plate 40, resulting in a larger tilt angle of the swash plate 40. Thus, the flow rate of the fluid discharged from the hydraulic pump 10 is increased.

Figure 8A:
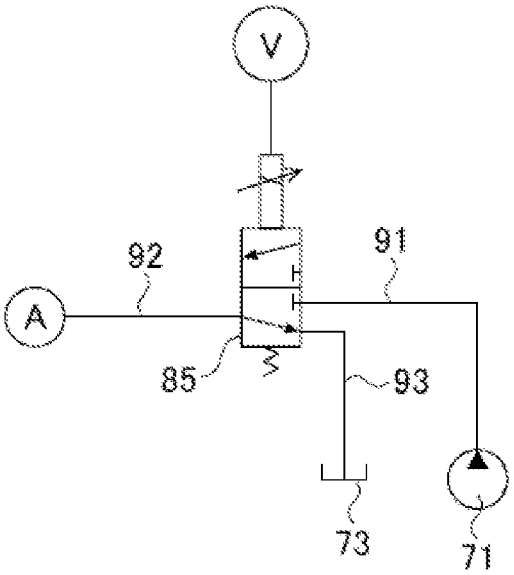
FIG. 8A shows still another variation of the hydraulic pump and explains the pressure input to the second pressing unit of the hydraulic pump.
Figure 8B:
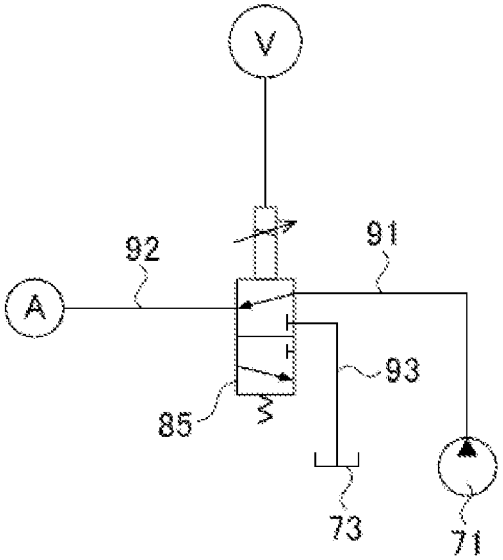
FIG. 8B explains, along with FIG. 8A, the pressure input to the second pressing unit of the hydraulic pump.

FIGS. 8A and 8B show still another variation of the hydraulic pump 10 and explain the pressure input to the second pressing unit 60 of the hydraulic pump 10. In the example shown, the pressure input to the second pressing unit 60 (the pressure supplied from the outside) is a fluid pressure converted from an electric signal (voltage signal) V by an electromagnetic proportional valve.

In the example shown, the directional control valve 85 is constituted by an electromagnetic proportional valve that operates to convert an input electric signal V into a pressure of the corresponding fluid pressure. The electric signal V may be an electric signal corresponding to any of the negative flow control pressure $P_N$, the positive flow control pressure PP, the load-sensing flow control pressure $P_{LS}$, and the lock lever pressure $P_{LL}$, or an electric signal corresponding to a combination of two of more of these pressures.

When the electric signal V input to the directional control valve 85 is small, the spool of the directional control valve 85 is positioned by the pressing force of the spring, and as shown in FIG. 8A, the flow passage 91 of the fluid running from the pilot pump 71 to the directional control valve 85 does not communicate with the flow passage 92 of the fluid running from the directional control valve 85 to the second pressing unit 60. In the example shown, the flow passage 92 communicates with the flow passage 93 running from the directional control valve 85 to the tank 73. In this state, the second pressing unit 60 does not receive the pressure of the fluid discharged from the pilot pump 71. Accordingly, as shown in FIG. 1, the pressing rod 61 does not press the swash plate 40, resulting in a smaller tilt angle of the swash plate 40. Thus, the flow rate of the fluid discharged from the hydraulic pump 10 is reduced.

When the electric signal V input to the directional control valve 85 is large, the spool of the directional control valve 85 is displaced by the pressing force of a solenoid driven in accordance with the electric signal V against the pressing force of the spring, and as shown in FIG. 8B, the flow passage 91 communicates with the flow passage 92. In the example shown, the flow passage 92 does not communicate with the flow passage 93 running from the directional control valve 85 to the tank 73. In this state, the second pressing unit 60 receives the pressure of the fluid discharged from the pilot pump 71. Accordingly, as shown in FIG. 2, the pressing rod 61 presses the swash plate 40, resulting in a larger tilt angle of the swash plate 40. Thus, the flow rate of the fluid discharged from the hydraulic pump 10 is increased.

In the hydraulic pump 10 according to any of the variations described above, the tilt angle of the swash plate 40 is the minimum when starting the drive source such as an engine, as in the hydraulic pump 10 according to the embodiment described with reference to FIGS. 1 to 3B. That is, the torque required for driving the hydraulic pump 10 is the minimum. Accordingly, even in a low-temperature environment where the viscosity of the fluid is high, the driving torque needed to start driving the hydraulic pump 10 can be small.

Naturally, the variations of the embodiment described above may be combined together in an appropriate manner.

What is claimed is:

1. A hydraulic pump comprising:

a cylinder block having a plurality of cylinder bores and disposed so as to be rotatable;

a plurality of pistons each retained in an associated one of the plurality of cylinder bores so as to be movable;

a swash plate configured to control an amount of movement of the plurality of pistons in accordance with a size of a tilt angle of the swash plate;

a first pressing unit configured to press the swash plate only by the elastic force of at least one spring in a tilt angle reducing direction so as to reduce the tilt angle of the swash plate;

a second pressing unit configured to press the swash plate in a tilt angle increasing direction so as to increase the tilt angle of the swash plate by a pressure supplied from outside of the hydraulic pump; and a plurality of shoes, each of the plurality of shoes mounted on an associated one of a plurality of end portions of the plurality of pistons, wherein the swash plate has a primary surface receiving the plurality of shoes, a first portion being in contact with the first pressing unit and a second portion being in contact with the second pressing unit, wherein an axis of rotation for the tilting of the swash plate is positioned apart from a straight line connecting the first portion and the second portion of the swash plate and is positioned on a cylinder block side of the straight line, wherein the primary surface protrudes toward the cylinder block from the straight line connecting the first portion and the second portion of the swash plate, wherein an axis of rotation for the tilting of the swash plate extends perpendicular to an axis of rotation of the cylinder block, wherein the axis of rotation for the tilting of the swash plate is positioned apart from the axis of rotation of the cylinder block and is positioned on a first pressing unit side of the axis of rotation of the cylinder block, and wherein the pressure supplied from outside of the hydraulic pump is a pressure corresponding to a load-sensing flow control pressure, a pressure corresponding to a positive flow control pressure or a pressure corresponding to a lock lever pressure.

2. The hydraulic pump of claim 1, wherein the second pressing unit includes a pressing rod configured to press the swash plate in the tilt angle increasing direction so as to increase the tilt angle of the swash plate, and wherein the pressure acts on an end surface of the pressing rod opposite to the swash plate.

3. The hydraulic pump of claim 2, further comprising:

a housing configured to house the cylinder block, the plurality of pistons, the swash plate, and the first pressing unit; and a guide portion configured to guide a side surface of the pressing rod, the guide portion being integral with the housing.

4. The hydraulic pump of claim 3, further comprising a stopper provided on the housing, wherein the swash plate is held by means of the first pressing unit and the stopper when the swash plate has a minimum tilt angle.

5. The hydraulic pump of claim 1, wherein a housing has a through hole facing the first pressing unit.

6. The hydraulic pump of claim 1, wherein the first pressing unit is configured to press the swash plate by a pressing force of a spring of the at least one spring.

* * * * *